United States Patent [19]

Kappenhagen et al.

[11] 4,361,209

[45] Nov. 30, 1982

[54] ELEVATOR SYSTEM

[75] Inventors: George A. Kappenhagen, Stroud Township, Monroe County; Leigh F. Jackson, Guilford, both of Pa.

[73] Assignee: Westinghouse Electric Corp., Pittsburgh, Pa.

[21] Appl. No.: 219,207

[22] Filed: Dec. 22, 1980

[51] Int. Cl.[3] ..... B66B 11/04

[52] U.S. Cl. ..... 187/17; 92/165 R; 182/141

[58] Field of Search ..... 187/17, 95; 52/115; 92/165, 178, 52, 53; 182/141

[56] References Cited

U.S. PATENT DOCUMENTS

| | | | |
|---|---|---|---|
| 773,478 | 10/1904 | Conner et al. | 187/17 |
| 827,282 | 7/1906 | Anderson | 187/17 |
| 3,016,992 | 1/1962 | Wilson | 52/115 |
| 3,271,791 | 9/1966 | Sarff | 187/95 |
| 3,413,767 | 12/1968 | Wilson | 52/115 |
| 3,650,356 | 3/1972 | Brown | 187/17 |

FOREIGN PATENT DOCUMENTS

| | | | |
|---|---|---|---|
| 451033 | 10/1927 | Fed. Rep. of Germany | 92/178 |

*Primary Examiner*—Joseph J. Rolla
*Assistant Examiner*—Kenneth Noland
*Attorney, Agent, or Firm*—D. R. Lackey

[57] ABSTRACT

An elevator system including an elevator car, and a hydraulic jack. The elevator car includes a metallic tunnel structure which extends vertically upward therethrough, with the hydraulic jack lifting and lowering the elevator car via contact with an end plate secured to the upper end of the tunnel. Stabilizer means in the tunnel, fixed to a predetermined portion of the hydraulic jack, coacts with the inner sidewalls of the tunnel to provide intermediate support and centering forces which promote coaxial alignment between the hydraulic jack and tunnel.

10 Claims, 8 Drawing Figures

FIG. 4
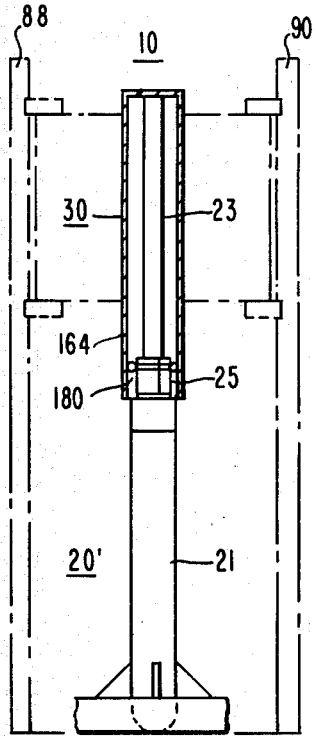
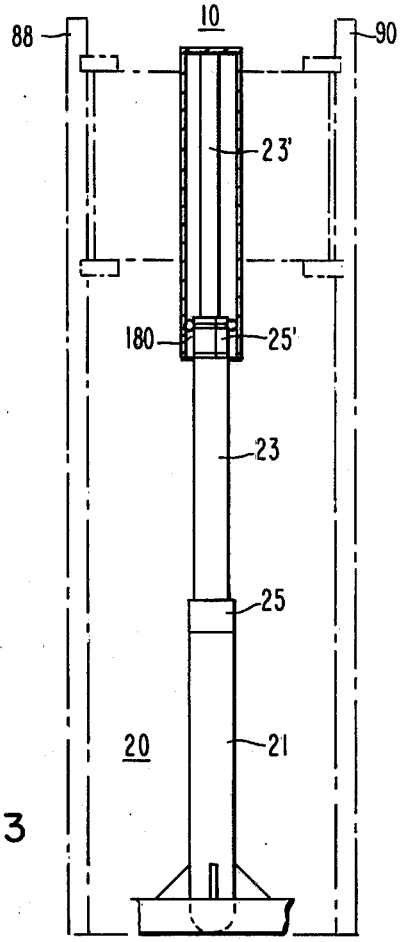
FIG. 3
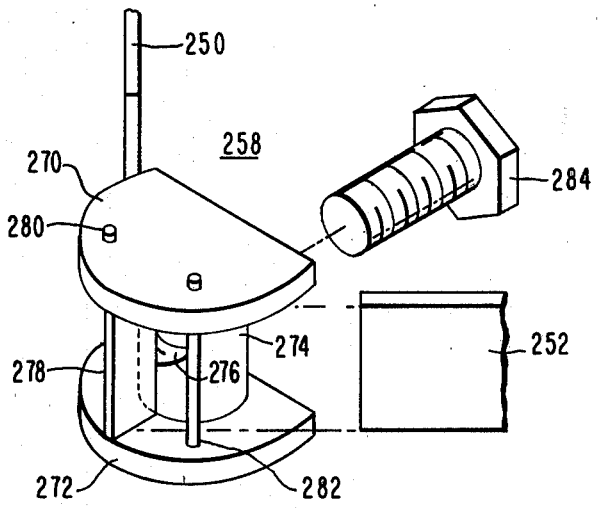
FIG. 8

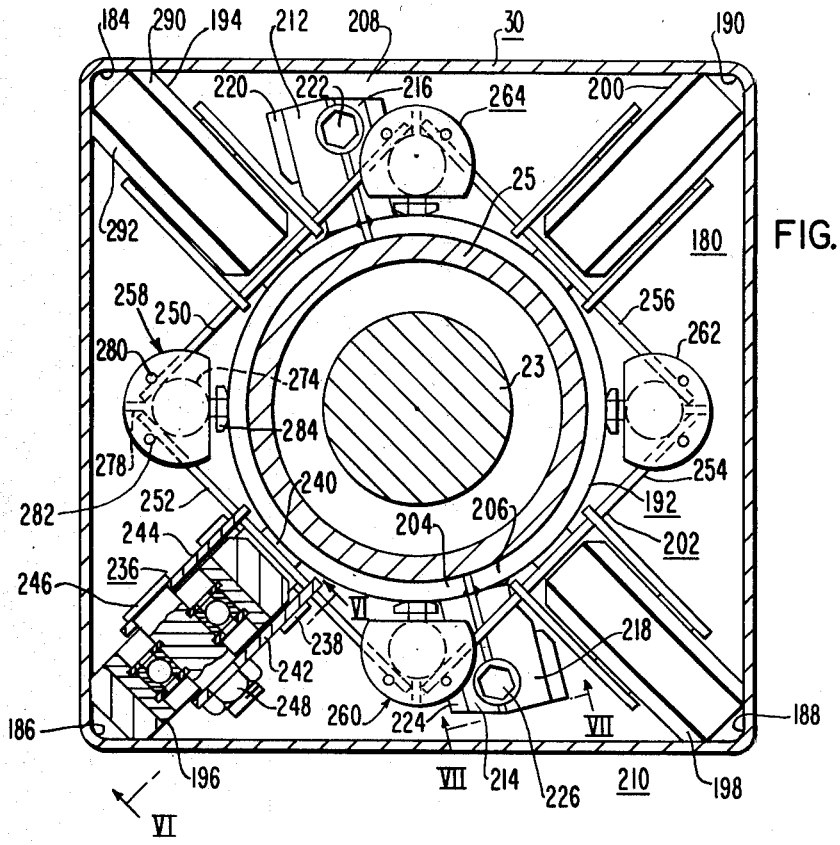
FIG. 5
FIG. 7
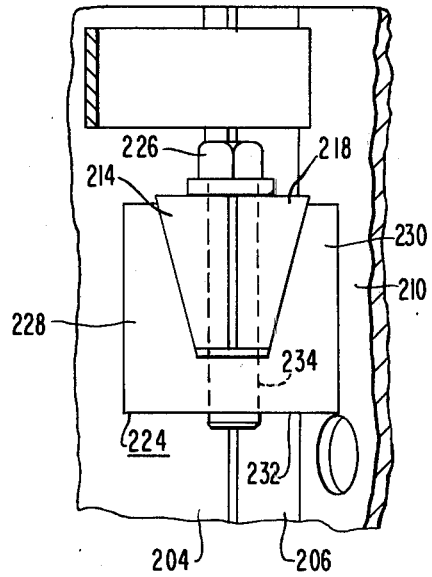
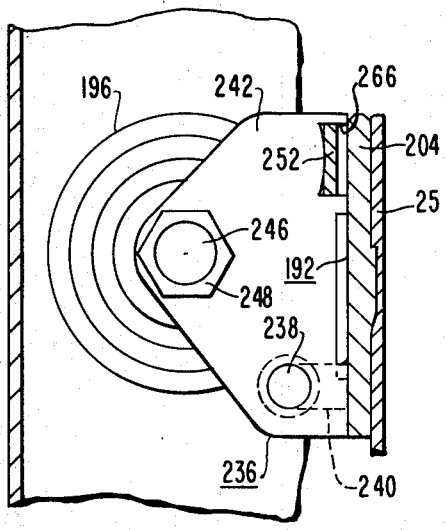
FIG. 6

ELEVATOR SYSTEM

BACKGROUND OF THE INVENTION

1. Field of the Invention

The invention relates in general to elevator systems, and more specifically to hydraulic elevator systems having stabilizing arrangements for the hydraulic jack.

2. Description of the Prior Art

Hydraulic jacks of hydraulic elevator systems having a high slenderness ratio, and telescopic jacks, may require intermediate support to promote coaxial alignment of the cylinder and plunger, and thus prevent buckling.

When such intermediate support is necessary, the prior art teaches support arms which extend between the plunger, or plungers, and external guides, such as the elevator guide rails. For example, support arms may be actuated to sequentially move into engagement, at spaced intervals, with the plunger as the elevator car moves upwardly, and out of engagement, and thus out of the path of the elevator car, as the elevator car moves downwardly. Still other prior art arrangements teach support arms which automatically clamp to, and unclamp from, the plunger, such that they can be actuated to clamp to and move with the plunger when the ascending car reaches a predetermined height.

Co-pending U.S. Application Ser. No. 219,103, filed Dec. 22, 1980, entitled "Elevator System " discloses a new and improved hydraulic elevator system in which the hydraulic jack extends upwardly through the elevator car within an enclosed tunnel structure which extends from the lower beam of the car frame or sling to a predetermined point at or above the upper beam, in order to eliminate the need for drilling a hole in the ground for receiving the hydraulic jack. The upper end of the plunger contacts an end plate at the upper end of the tunnel. If more than about 16 feet of vertical travel is desired, the hydraulic jack would be of the telescopic type, if a hole for the jack is to be avoided. According to the prior art, stabilizer arms would be provided which would be actuated as the elevator car travels upwardly, which arms would extend from a plunger, or plungers of the telescopic hydraulic jack, to the elevator guide rails.

SUMMARY OF THE INVENTION

The present invention is a new and improved hydraulic elevator system of the type which eliminates the need for, or minimizes the depth of, a hole for the hydraulic jack, by utilizing a tunnel structure disposed upwardly through the elevator car, as disclosed in the hereinbefore mentioned co-pending application. Instead of providing additional support directly from the hydraulic jack to the guide rails via stabilizer arms, with their attendant complicated arrangements for actuating them at the proper time as the hydraulic jack extends, and for deactivating them as the hydraulic jack lowers the car, the present invention provides a stabilizer assembly within the tunnel, which is always fixed to a selected portion of the hydraulic jack. The tunnel is extended below the elevator car such that the stabilizer assembly remains in contact with the tunnel, even at the maximum extension of the hydraulic jack, providing an intermediate support point which travels from the top of the tunnel to its lower end during the last stage of extension.

Thus, a firm additional support point is indirectly provided from the hydraulic jack to the elevator guide rails via (a) a stabilizer assembly, which is permanently fixed to the hydraulic jack, (b) the tunnel structure, which is permanently fixed to the car frame or sling, and (c) the guide roller assemblies, which are permanently fixed to the car frame, and which rotate against the guide rails throughout the vertical travel path of the elevator car. This additional firm support point is provided without complicated synchronizing arrangements for actuating the additional support during ascension of the elevator car, and for deactivating the support during descension.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which:

FIG. 3 is an elevational view of an elevator system similar to that of FIG. 2, except illustrating the system in the completely extended mode of telescopic hydraulic jack;

FIG. 4 is an elevational view of an elevator system similar to that of FIG. 3, except illustrating the extended mode of a single stage hydraulic jack;

FIG. 5 is a cross-sectional view of the tunnel structure shown in FIG. 2, taken between and in the direction of arrows V—V, which sets forth a plan view of a suitable stabilizer assembly which may be used;

FIG. 6 is an elevational view of a portion of the stabilizer assembly shown in FIG. 5, taken between and in the direction of arrows VI—VI;

FIG. 7 is an elevational view of a portion of the stabilizer assembly shown in FIG. 5, taken between and in the direction of arrows VII—VII; and FIG. 8 is an exploded perspective view of the biasing arrangement of the stabilizer assembly shown in FIG. 5.

DESCRIPTION OF PREFERRED EMBODIMENTS

Figure 1:
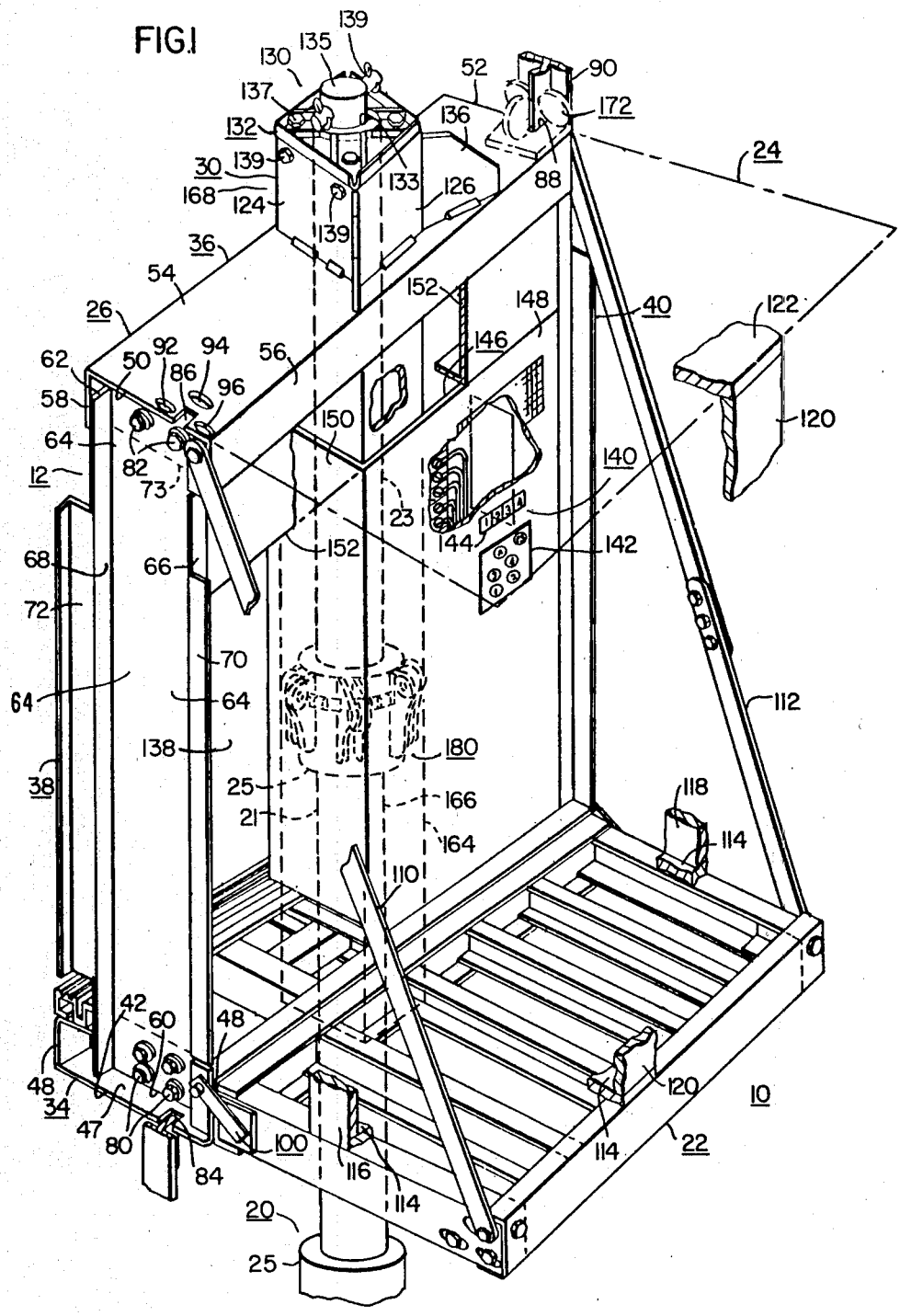
FIG. 1 is a perspective view of an elevator system constructed according to the teachings of the invention.

Certain features shown in the drawings but not claimed are claimed in concurrently filed co-pending applications. The tunnel arrangement is claimed in Application Ser. No. 219,103, entitled "Elevator System", and the folding platform arrangement is claimed in Application Ser. No. 219,206, entitled "Modular Elevator Car."

Figure 2:
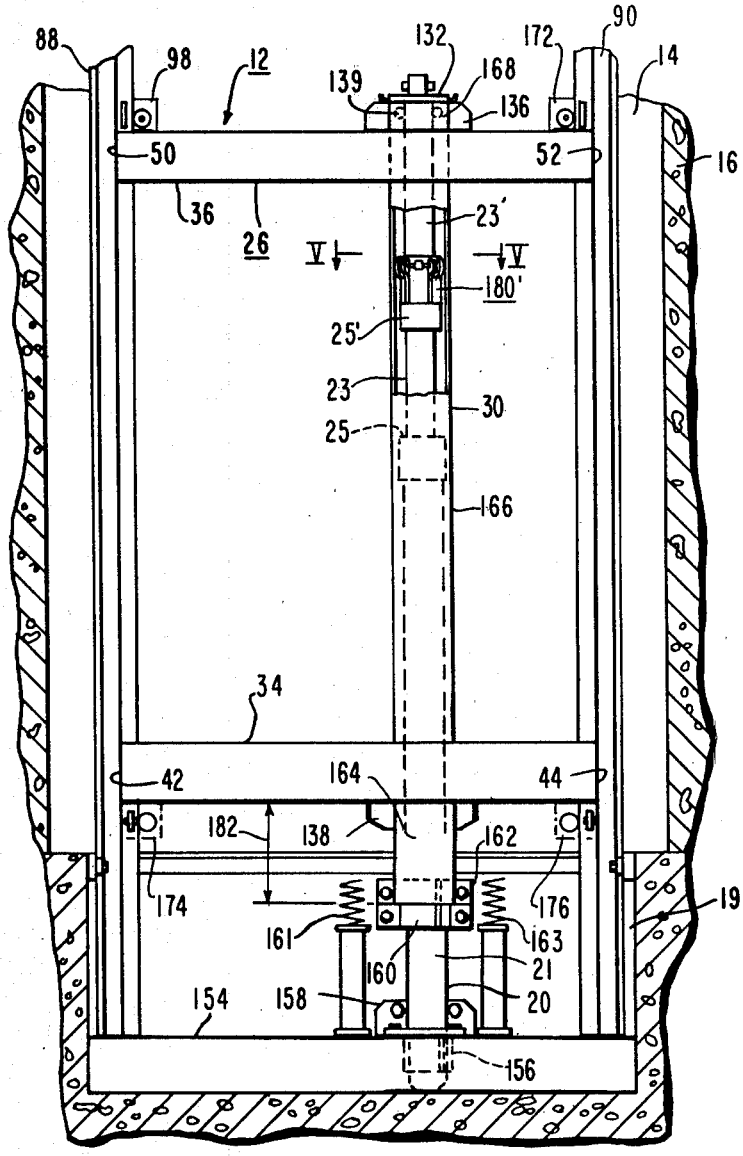
FIG. 2 is a rear elevational view of the elevator system shown in FIG. 1, with certain parts broken away, in order to more clearly illustrate the invention.

Referring now to the drawings, FIG. 1 is a perspective view of an elevator system 10 constructed according to the teachings of the invention, and FIG. 2 is a rear view of elevator system 10, in elevation. Elevator system 10 includes an elevator car 12 mounted in a hatchway 14 of a building 16 to serve the floors therein. A single hydraulic jack 20 mounted in the hatch pit 19 at the bottom of hatchway 14 provides the motive means for elevator car 12. Hydraulic jack 20 may be a telescopic jack, having a cylinder 21, a cylinder head 25, a first plunger 23, a cylinder head 25', and a second plunger 23', or it may be a conventional single stage jack.

Elevator car 12 includes a platform 22, a cab 24 mounted on platform 22, and structural support means or car frame 26 for supporting the platform and cab according to the teachings of the invention. The structural support means 26 includes a metallic elongated tunnel-like structure 30 for receiving the hydraulic jack 20, eliminating or reducing the depth of a hole in the ground for the hydraulic jack, as will be hereinafter explained. In a preferred embodiment of the invention, the tunnel structure 30 is disposed at the extreme front of the elevator car 12, and the invention will be described in this context.

In the exemplary embodiment illustrated, car frame or sling 26 includes bottom and top portions, such as provided by bottom and top beam members 34 and 36, respectively, and first and second side portions, such as provided by upstanding stile members 38 and 40. Bottom beam member 34 has first and second ends 42 and 44, respectively, and a predetermined cross-sectional configuration, such as the substantially U-shaped cross-sectional configuration illustrated. The U-shaped configuration includes a first upstanding leg portion 46, a bight 47, and a second upstanding leg portion 48.

The top beam member 36 has first and second ends 50 and 52, respectively, and a predetermined cross-sectional configuration, such as the substantially U-shaped cross-sectional configuration illustrated, which includes a bight portion 54, and first and second depending leg portions 56 and 58, respectively.

The upstanding stile members 38 and 40 each have first and second ends, such as first and second ends 60 and 62, respectively, of stile member 38. The stile members, such as stile number 38, have predetermined cross-sectional configurations, such as a substantially U-shaped cross-sectional configuration including a bight portion 64 and first and second leg portions 66 and 68, respectively. The first and second leg portions may include integral flanges 70 and 72 at their ends, with the flanges being aligned with one another but bent in opposite directions.

Mounting brackets may be welded between the leg portions of the top beam member 36, one adjacent to each end, such as mounting bracket 73 at end 50, to provide mounting points for diagonal brace members 110 and 112, as well as for the second ends of stile members 38 and 40.

Tunnel 30 and stile members 38 and 40 are vertical structural members of the car frame. They may be constructed such that the primary vertical support function is provided by the tunnel 30, or by the stile members 38 and 40, or they may equally share the vertical support. As illustrated, suitable nut and bolt assemblies may be used to connect the first ends of the stile members 38 and 40 to the second ends of the stile members 38 and 40 to the mounting brackets associated with the top beam member 36, such as nut and bolt assemblies 80 at the bottom beam member 34, and nut and bolt assemblies 82 at the top beam member 36.

The bottom and top beam members 34 and 36 have slots cut in their bight portions, at their extreme ends, such as slot 84 in end 42 of bottom beam member 34, and slots 86 and 88 in ends 50 and 52, respectively, of top beam member 36, for receiving the nose portion of a guide rail, such as guide rails 88 and 90. The bight portions of the bottom and top beam members 34 and 36 additionally include a plurality of elongated openings adjacent to the guide rail slots or mounting guide roller assemblies, such as openings 92, 94 and 96 adjacent to guide rail slot 86 in the top beam member 36, for receiving a guide roller assembly 98, which is shown in FIG. 2.

Platform 22 is constructed to cooperate with the bottom beam 34 of the car frame to define a composite platform for the elevator car. As disclosed in the hereinbefore mentioned copending application, platform 22 is pivotable between the operating position shown to a vertically oriented shipping configuration, via hinge assemblies, such as hinge assembly 100.

Diagonal side brace members 110 and 112 are fixed between the sling 26 and platform 22, such as by bolting member 110 to bracket 73 and to the platform 22. Brace members 110 and 112 are constructed to cooperate with the folding platform 22 as it is operated between the shipping and operative configurations.

Suitable flooring 114 is mounted on platform 22, and the cab 24 is mounted on the flooring 114, with the cab including side panels 116 and 118, a back panel 120, and a ceiling 122.

Elongated tunnel structure 30, which may have a round, or non-round, opening therein, such as the square configuration illustrated, extends through a suitable opening in the bottom beam member 34. Depending upon tunnel length, it may also extend through an opening in the top beam member 36. When structure 30 defines a square opening, it may have four metallic side members 124, 126, 128 and 130 suitably fixed together, such as by welding. Tunnel structure 30 includes an end plate 132 against which the end of the plunger 23 makes contact. End plate 132 may have a small opening 133 therein for receiving a portion 135 of the top of the plunger 23, to clearly indicate that the plunger 23 is properly centered on the end plate 132. A pin 139 may be secured in a transverse opening in portion 135. Sight openings (not shown) for visual checks may also be provided in the tunnel structure, or the end plate, or both.

Since it is desirable to eliminate the normal hole for receiving the hydraulic jack 20, or to at least minimize the depth of the hole, the end plate 132 is preferably located well above the level of the upper beam 36. End plate 132 is a structural part of the car frame 26, which result may be accomplished by welding at least certain of the metallic sides 124, 126, 128 and 130 of the tunnel structure 30 to the upper and lower beam members 36 and 34, respectively. As illustrated, additional strengthening ribs or members 136 and 138 may be welded to the tunnel structure 30 and to the top and bottom beam members 36 and 34, respectively. End plate 132 is preferably removably fixed to the metallic side members which define the tunnel structure 30, such as by heavy bolts. For example, bolts 137 may secure mounting blocks (not shown) to end plate 132, and bolts 139 may secure end plate 132 to tunnel 30 by extending through openings in the sides of tunnel 30 into threaded openings in the mounting blocks.

Instead of terminating the tunnel structure 30 at the upper beam member 36, the tunnel structure 30 preferably extends downwardly, completely through the elevator car 12, such that it extends through and well below the bottom beam member 34. This arrangement of the tunnel causes the tunnel to completely surround and protect the hydraulic jack 20, as well as providing segregation and isolation between the hydraulic jack 20 and the inside of the elevator car 12. The tunnel 30, being a strong steel tubular structure welded to the lower and upper beam members of the car frame, adds significant strength to the car frame 26, as hereinbefore pointed out.

Locating the tunnel 30 at the extreme front of the elevator car 12 enables it to be concealed from the view of passengers in the elevator car 12, as it may be conveniently located between an opening 138 which defines the entranceway into cab 24, and the car mounted operational controls 140, such as the car call pushbutton station 142 and the car position indicator 144. An L-shaped swing return panel 146 having first and second legs 148 and 150, respectively, may have the first leg 148 disposed to form a portion of the internal cab front, upon which certain of the operational controls are mounted, and the second leg 150 disposed to provide a side wall of the entranceway. A transom 152 is disposed above the swing return panel 146, and above opening 138, also adding to the concealment of the tunnel structure 30.

FIG. 2 is a rear elevational view of elevator system 10 shown in FIG. 1, except that the elevator car 12 is shown without the cab 24, without stiles 38 and 40, without the car mounted operational controls 140, and without the swing return panel 146, in order to more clearly illustrate certain aspects of the invention. The cylinder portion 21 of hydraulic jack 20 may be secured in the hatch pit 19 via a rectangular structural steel frame 154 which includes a lower clamp assembly 156. Frame 154 and clamp assembly are secured to a wall of pit 19 via bracket 156. Cylinder 21 is additionally supported by an upper clamp assembly 160 which is secured to the wall of the hatch pit via a bracket 162. Spring buffers 161 and 163 may also be mounted on frame 154.

Tunnel structure 30 includes a lower portion 164 disposed to extend well below the bottom beam member of the car frame 12, for purposes to be hereafter described, an intermediate portion 166 disposed between the lower and upper beam members of the car frame or sling 12, and an upper portion 168 disposed above the upper beam member. The lower portion may have a slot 170 aligned with the support arm which extends between the upper clamp assembly 160 and mounting bracket 162, in order to prevent interference therebetween when the elevator car 12 is at the lower end of its vertical travel path.

In addition to guide roller assembly 98, elevator car 12 includes guide roller assemblies 172, 174 and 176, with guide roller assemblies 98 and 174 co-acting with guide rail 88, and with guide roller assemblies 172 and 176 co-acting with guide rail 90, to guide elevator car 12 smoothly and accurately in its vertical travel path as it is lifted and lowered via contact between the upper end of plunger 23 and the end plate 132.

It will be noted that the motive means for elevator car 12 is a single hydraulic jack 20 disposed completely within the vertical projection of the elevator car 12. It will further be noted that cylinder 21 is merely disposed on the bottom of hatch pit 19, without the necessity of being disposed in a costly drilled hole, and yet the elevator car 12 may be vertically operated between a plurality of floor levels. The number of floor levels is determined by the height of the upper portion 168 of the tunnel 30, the distance between the floors, and whether or not the hydraulic jack has a single plunger, or is a telescopic jack. Further, instead of loading the elements of the car frame 26 in compression, as in the prior art, the elements of the car frame are loaded essentially in tension.

According to the teachings of the invention, stabilizer means 180 is provided within tunnel 30, with stabilizer means 180 being fixed to the section of hydraulic jack 20 which is immediately below the uppermost plunger section. Thus, with a telescopic jack, such as the jack illustrated in FIGS. 1, 2 and 3, the stabilizer means 180 is fixed to the first plunger 23.

Stabilizer means 180 is fixed immediately adjacent to the upper end of the associated cylinder or stage. For example, in the telescopic jack embodiment set forth in FIGS. 1, 2 and 3, stabilizer means 180 would be fixed to stage 23, such as to cylinder head 25'. In the single stage jack embodiment of FIG. 4, stabilizer means 180 would be fixed to cylinder head 25. Thus, when the single plunger of a conventional hydraulic jack is retracted, and also when the stages of a telescopic jack are all retracted, the stabilizer means 180 will be located immediately adjacent to end plate 132. As will be hereinafter described in detail, stabilizer means 180 is constructed such that it can be easily installed, removed, or serviced, simply by removing end plate 132.

As hereinbefore stated, in a preferred embodiment of the invention, it is important that tunnel 30 extends well below the bottom beam member 34. The dimension 182 of this lower portion 164 of tunnel 30 is determined by the location of the stabilizer means 180 when the hydraulic jack 20 is fully extended. When the jack 20 is fully extended, the stabilizer means 180 should still be within tunnel 30, and thus the dimension 182 of the lower portion 164 of the tunnel structure is selected to accomplish this result. Slots are provided in the lower section 164, as required, to eliminate any interference between the lower section 164 and any lateral support braces on cylinder 21.

FIG. 3 is a diagrammatic view, in elevation, of the elevator system 10 showing FIGS. 1 and 2, illustrating that the stabilizer means 180 is still within tunnel 30 when the telescopic jack 20 is fully extended. FIG. 4 is a view similar to that of FIG. 3, except illustrating a fully extended single-stage jack 20'.

Stabilizer means 180 is fixed to the predetermined section of the associated hydraulic jack, as hereinbefore stated, and it makes contact with selected inner surfaces of tunnel 30. The contact is preferably a rolling contact, to reduce drag, and it is preferably a firmly biased and balanced contact. It is firmly biased to provide a firm additional guide point, and it is balanced such that the forces created are centering forces, i.e., forces which create and maintain the desired coaxial relationship between the vertical longitudinal center lines of all sections of the hydraulic jack, and between the sections of the jack and the vertical longitudinal center line of the tunnel 30.

In a preferred embodiment of the invention, tunnel 30 has a square cross-sectional configuration, with the four inner right angle corners thereof being used as guiding locations. FIGS. 5, 6, 7 and 8 illustrate a stabilizer assembly which may be used for stabilizer means 180 when tunnel 30 has a square cross-sectional configuration.

More specifically, FIG. 5 is a cross-sectional view of tunnel 30 shown in FIG. 2, taken just above the location of stabilizer means 180. Tunnel 30 may be formed from a single flat sheet of steel, which is bent into a square, tubular configuration, and seam welded. Another suitable arrangement would be to form the four inner corners from four right angle members, with the right angle members being interconnected and supported in the proper spaced relationship by flat plate members welded to the right angle members. In any event, tunnel 30 defines first, second, third and fourth inner corners 184, 186, 188 and 190, respectively. Stabilizer means 180 includes mounting or support means 192 for attaching the stabilizer assembly 180 to the selected portion of the hydraulic jack 20, guide rollers 194, 196, 198 and 200 attached to said mounting means 192, and bias means 202 for biasing guide rollers 194, 196, 198 and 200 against their associated guide corners 184, 186, 188 and 199, respectively.

Mounting means 192 is attachable to, and detachable from, hydraulic jack 20 via the upper end of tunnel 30, when end plate 132 is removed. The elevator car 12 may be lowered to and supported by the spring buffers 161 and 163 located in the hatch pit 19 during this procedure. Mounting means 192 is in the form of a split clamp having first and second clamp sections or portions 204 and 206, respectively, with the clamp portions being assembled about cylinder head 25 and clamped together by clamping means 208 and 210.

FIG. 6 is a cross-sectional view through clamp portion 204 illustrating that it is preferably in the form of a sleeve or collar, with its inner surface, and the outer surface of cylinder head 25 being cooperatively configured to positively seat the clamping sections 204 and 206 against the associated cylinder head. This positive seating not only makes it easy to locate and mount the stabilizer assembly, but it prevents slippage of the assembly during operation thereof.

Clamp section 204 has first and second wedge members 212 and 214, respectively, welded adjacent to the ends of its C-shaped configuration, and clamp section 206 has first and second wedge members 216 and 218, respectively, welded adjacent to the ends of its C-shaped configuration. Clamping means 208 includes the first wedge members 212 and 216, a U-shaped wedge member 220, and a bolt 222. Clamping means 210 includes the second wedge members 214 and 218, a U-shaped wedge member 224, and a bolt 226. As best shown in FIG. 7, which is an elevational view of clamping means 210 taken between and in the direction of arrows VII—VII in FIG. 5, the U-shaped wedge member 224 includes first and second leg members 228 and 230, and a bight 232. The inner surfaces of leg members 228 and 230 are inclined at an angle selected such that the external surfaces of wedge members 214 and 218 will make intimate sliding contact therewith. A threaded opening 234 is provided through bight 232 for receiving bolt 226, and the mating surfaces of wedge surfaces 214 and 218 cooperatively define an opening for receiving bolt 226. To assemble the two clamp sections 204 and 206 about hydraulic jack 20, the two clamp sections are assembled such that the first wedge members 212 and 216 are immediately adjacent to one another, and the second wedge members 214 and 218 are immediately adjacent to one another. The U-shaped members 220 and 224 are assembled under the wedge members, the bolts 222 and 226 inserted through the cooperatively defined openings of the assembled wedge members, and they are threadably engaged with the tapped openings in the bight portions of members 220 and 224. Tightening bolts 222 and 224, which is accomplished from above through the upper end of the tunnel 30, forces the inclined surfaces of the wedge members closer together as they are wedged down the inclined inner surfaces of the two legs of the U-shaped members, to tightly clamp the two clamp sections 204 and 206 about the hydraulic jack 20.

Each clamp section further includes first and second mounting means associated therewith for mounting two of the guide rollers. Since each of the guide roller mounting means is similar, only the mounting means for mounting guide roller 196 will be described in detail. FIG. 6 is an elevational view of mounting means 236, taken between and in the direction of arrows VI—VI in FIG. 5.

More specifically, mounting means 236 includes a pivot pin 238, a block member 240, first and second spaced plate members 242 and 244, and an axle bolt 246. Pivot pin 238 is welded to block member 240, which in turn is welded to clamp section 204. The first and second spaced plate members 242 and 244 each have an opening for receiving an end of pivot pin 238, and an opening for receiving the axle bolt 246. The axle bolt 246 secured roller 196 between the plate members 242 and 244, and it also secures the plate members to the pivot pin, when a nut 248 is assembled with the axle bolt 246.

Bias means 202 includes first, second, third and fourth leaf spring members 250, 252, 254 and 256, respectively, and first, second, third and fourth tension adjusting means 258, 260, 262 and 264, respectively. As illustrated in FIG. 6, the pivot axis for plate members 242 and 244, provided by pivot pin 238, is located toward the lower ends of the plate members. The upper ends of the plate members include notches for receiving the leaf spring members, such as notch 266 in plate member 242 for receiving leaf spring 252. The leaf spring members are disposed through the notches of their associated plate members, and each of their ends extend into one of the tension adjusting means.

Since each of the tension adjustment means is of like construction, only tension adjusting means 258 will be described in detail. FIG. 8 is a perspective view of tension adjusting means 258, and this Figure, along with FIG. 5, will be referred to in the following description.

Tension adjusting means 258 includes first and second spaced, parallel plate members 270 and 272, respectively, with these plate members being held in spaced relation by a substantially circular column member 274 having a tapped opening 276 disposed perpendicular to its longitudinal axis. A stop member 278 and first and second pin members 280 and 282 also extend between the first and second spaced plate members 270 and 272. A screw 284 is threadably engaged with the tapped opening 276. An end of leaf spring 250 extends between pin member 280 and column member 274, with its end in contact with the stop member 278. An end of leaf spring member 252 extends between pin member 282 and column member 274, with its end also being in contact with stop member 278. The head of screw 284 is disposed against the outer surface of clamp portion 204. Adjusting screw 284 in, or out, thus controls the positions of the ends of the leaf spring members, adjusting the spring bias and thus the contact pressure between the guide rollers and their associated inner corner of the tunnel structure. It will be noted that the spring bias adjustment may be made from above, permitting such adjustment to be made when end plate 132 is removed from the top of the tunnel structure 30.

The guide rollers are chamfered, such as the chamfers 290 and 292 on guide roller 194, to provide surfaces which make contact with the two inner walls which cooperatively define the corner angle associated with the guide roller.

Proper adjustment of the tension in the leaf spring members provides centering forces on the hydraulic jack 20 which start at the guide rails 88 and 90, and are transmitted to the car frame via guide roller assemblies 172, 174, 98 and 176, and from the car frame to the tunnel 30, which is part of the car frame. The tunnel walls operate through the resiliently mounted guide rollers of the stabilizer means to apply centering forces to the split clamp mounting arrangement of the stabilizer assembly, which in turn applies the centering forces to the hydraulic jack. The centering forces travel along the tunnel structure as the elevator car is lifted and lowered by the hydraulic jack 20, with the application point of these forces increasing in distance from the end plate 132 as the elevator car is lifted, to increasingly space the contact points on the tunnel 30, i.e., the contact with end plate 132, and the contact provided by stabilizer means 180. The centering forces are continuously applied at the transition between the uppermost plunger and the next lower stage, with the centering forces being directly applied to this next lower stage, preventing any tendency of these two sections of the hydraulic jack to buckle, as well as improving cylinder head life. This stabilizing action occurs automatically at the correct location on the hydraulic jack as the elevator car is lifted and lowered, without the use of costly, complicated synchronized stabilizer arms, such as used in prior art stabilizing arrangements.

We claim as invention:

1. An elevator system, comprising:

an elevator car having a platform, a cab on said platform, and a car frame for supporting said cab and platform, said car frame including an elongated tunnel member having a vertically oriented longitudinal axis, said tunnel member having sidewall portions which define an opening which extends between lower and upper ends, with said upper end being at least partially closed and said lower end being open, said side portions of the tunnel member defining a substantially square cross-sectional configuration having first, second, third and fourth inner corners, a hydraulic jack having a cylinder fixed below said elevator car with its longitudinal axis coaxial with the longitudinal axis of said tunnel, and at least one plunger, said at least one plunger having an upper end, said hydraulic jack extending into the open lower end of said tunnel, with the upper end of said at least one plunger in contact with the at least partially closed upper end of said tunnel, and stabilizer means in said tunnel fixed to said hydraulic jack, said stabilizer means coacting with at least certain of the sidewall portions of said tunnel to provide centering forces which promote coaxial alignment of said cylinder, said at least one plunger and said tunnel, said stabilizer means including first, second, third and fourth rollers which coact with said first, second, third and fourth corners, respectively.

2. The elevator system of claim 1 wherein the hydraulic jack has a single plunger and a single cylinder, with said stabilizer means being secured to said single cylinder.

3. The elevator system of claim 1 wherein the hydraulic jack is a telescopic jack having at least an uppermost stage and an additional stage immediately adjacent thereto, with the at least one plunger being the uppermost stage, and with said stabilizer means being fixed to said additional stage.

4. The elevator system of claim 1 including biasing means disposed to bias the first, second, third and fourth rollers against said first, second, third and fourth inner corners, respectively.

5. The elevator system of claim 4, wherein the biasing means includes a plurality of spring members and including means for adjustably selecting the magnitude of the biasing forces provided by said spring members.

6. The elevator system of claim 1 including support means fixed to said cylinder, and wherein the tunnel extends downwardly below the elevator car, with the lower end of the tunnel being cooperatively formed to extend past the start of said support means, to enable the stabilizer means to remain in contact with the tunnel during maximum extension of the hydraulic jack.

7. An elevator system, comprising:

an elevator car having a platform, a cab on said platform, and a car frame for supporting said cab and platform, said car frame including an elongated tunnel having a vertically oriented longitudinal axis, said tunnel having sidewall portions which define an opening which extends between lower and upper ends, with said upper end being at least partially closed and said lower end being open, a hydraulic jack having a cylinder fixed below said elevator car with its longitudinal axis coaxial with the longitudinal axis of said tunnel, and at least one plunger, said at least one plunger having an upper end, said hydraulic jack extending into the open lower end of said tunnel, with the upper end of said at least one plunger in contact with the at least partially closed upper end of said tunnel, and stabilizer means in said tunnel fixed to said hydraulic jack, said stabilizer means coacting with at least certain of the sidewall portions of said tunnel to provide centering forces which promote coaxial alignment of said cylinder, said at least one plunger and said tunnel, said at least partially closed upper end of the tunnel including a removable end plate, with said stabilizer means being located such that when the hydraulic jack is retracted and said removable end plate removed, the stabilizer means is adjacent to, and accessible through, the upper end of the tunnel.

8. The elevator system of claim 7 wherein the stabilizer means is insertable, and removable, from the upper end of the tunnel, when the removable end plate is removed.

9. An elevator system, comprising:

an elevator car having a platform, a cab on said platform, and a car frame for supporting said cab and platform, said car frame including an elongated tunnel having a vertically oriented longitudinal axis, said tunnel having sidewall portions which define an opening which extends between lower and upper ends, with said upper end being at least partially closed and said lower end being open, a hydraulic jack having a cylinder fixed below said elevator car with its longitudinal axis coaxial with the longitudinal axis of said tunnel, and at least one plunger, said at least one plunger having an upper end, said hydraulic jack extending into the open lower end of said tunnel, with the upper end of said at least one plunger in contact with the at least partially closed upper end of said tunnel, and stabilizer means in said tunnel fixed to said hydraulic jack, said stabilizer means coacting with at least certain of the sidewall portions of said tunnel to provide centering forces which promote coaxial alignment of said cylinder, said at least one plunger and said tunnel, said stabilizer means including first and second similar half sections adapted to be placed about the hydraulic jack, and clamping means for clamping said first and second half sections in assembled relation about the hydraulic jack.

10. The elevator system of claim 9 wherein the clamping means includes first and second split wedge clamps actuatable from above.

* * * * *